US005244451A

United States Patent [19]

Retter

[11] Patent Number: 5,244,451

[45] Date of Patent: Sep. 14, 1993

[54] METHOD FOR OPERATING A WORM CENTRIFUGE HAVING A PRESSURIZED GAS INTRODUCTION

[75] Inventor: Eric Retter, Cologne, Fed. Rep. of Germany

[73] Assignee: Kloeckner-Humboldt-Deutz AG, Fed. Rep. of Germany

[21] Appl. No.: 835,780

[22] Filed: Feb. 14, 1992

[30] Foreign Application Priority Data

Feb. 14, 1991 [DE] Fed. Rep. of Germany ..... 4104483

[51] Int. Cl.[5] ..... B04B 1/20; B04B 11/00

[52] U.S. Cl. ..... 494/37; 494/5; 494/10; 494/25; 494/26; 494/53

[58] Field of Search ..... 494/1, 5, 10, 23, 25, 494/26, 37, 43, 50–56, 85, 47; 210/360.1, 380.1, 380.3, 143, 209, 221.2, 704

[56] References Cited

U.S. PATENT DOCUMENTS

| | | | |
|---|---|---|---|
| 479,453 | 7/1892 | Peck | 494/25 |
| 2,056,885 | 10/1936 | Pecker | 494/25 X |
| 2,283,457 | 5/1942 | Pecker | 210/380.3 X |
| 2,612,314 | 9/1952 | Huelsdonk | 494/53 X |
| 3,795,361 | 3/1974 | Lee | 494/26 |
| 3,885,734 | 5/1975 | Lee | 494/25 |
| 4,299,352 | 11/1981 | Erickson | 494/27 |
| 4,790,806 | 12/1988 | High | 494/26 |
| 4,898,571 | 2/1990 | Epper et al. | 494/26 |
| 5,176,616 | 1/1993 | Schlip et al. | 494/37 |

FOREIGN PATENT DOCUMENTS

| | | | |
|---|---|---|---|
| 576123 | 10/1977 | U.S.S.R. | 494/26 |

*Primary Examiner*—Harvey C. Hornsby
*Assistant Examiner*—Charles Cooley
*Attorney, Agent, or Firm*—Hill, Steadman & Simpson

[57] ABSTRACT

A method for operating and improving the throughput and efficiency of a worm centrifuge by introducing, at a controlled frequency, successive pressure surges into the concentrated sludge fraction within the bowl separator preceding the solids discharge opening whereby the pulse frequency and the level of pressure are controllable and can be controlled as a function of the sludge fraction throughput through the separator.

13 Claims, 1 Drawing Sheet

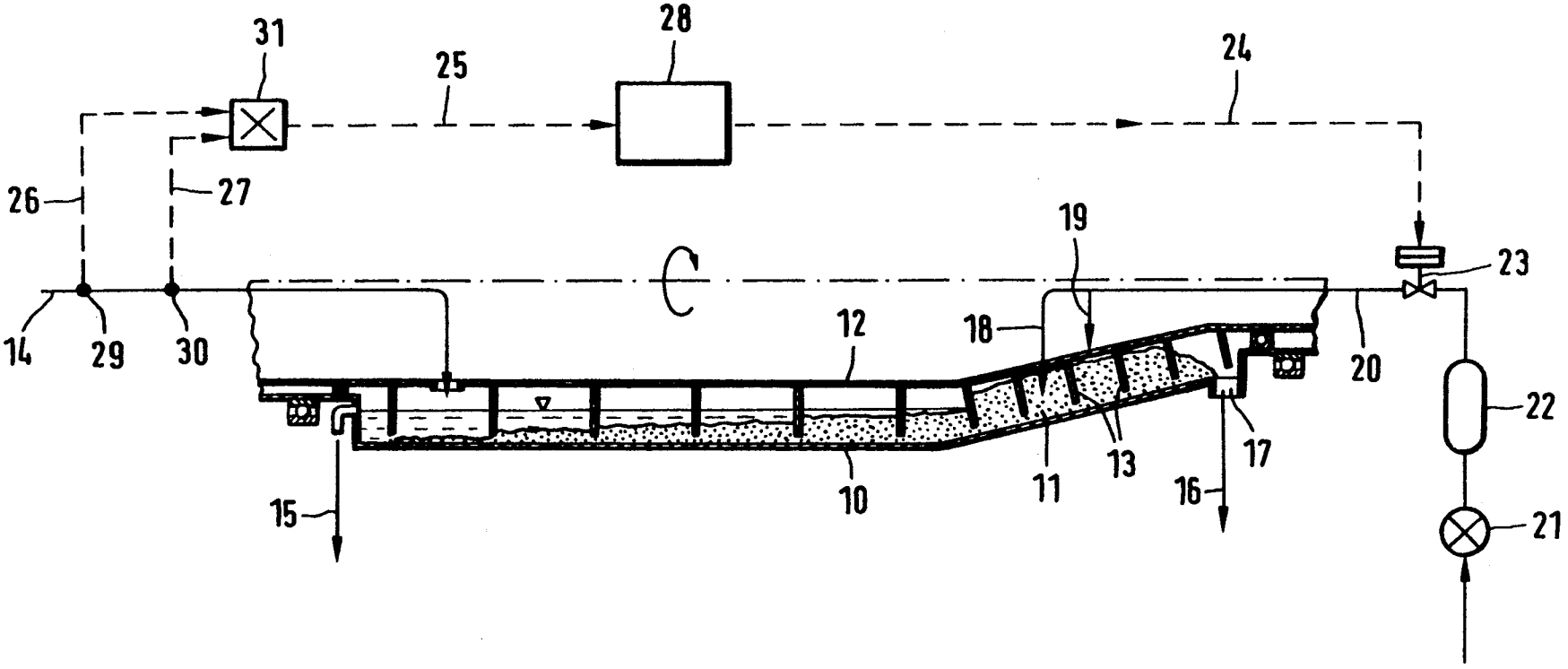
23
22
21
20
24
17
16
13
19
11
18
12
10
28
25
15
31
27
30
29
26
14

METHOD FOR OPERATING A WORM CENTRIFUGE HAVING A PRESSURIZED GAS INTRODUCTION

BACKGROUND OF THE INVENTION

The invention relates to improvements in centrifugal worm centrifuges separating liquid/solids mixtures, such as for thickening a thin slurry.

More particularly, the invention relates to an improvement wherein a gaseous pressure medium is introduced into the concentrated sludge in a location preceding the solids discharge opening in the centrifuge bowl. The invention involves operation with a bowl centrifuge wherein the bowl is driven in rotation with a worm therein driven at a speed of rotation different than the bowl. Generally, the bowl will be provided with an axial slurry admission inlet at one end, and the bowl will have an outlet for the liquids fraction at one end and a discharge for the concentrated sludge fraction at the other end. In addition, means will be provided for the introduction at one or more locations of a gaseous pressure medium into the concentrated sludge at a region preceding the solids discharge opening of the basket shell.

Such a worm centrifuge is disclosed in German Published Application 39 21 328 , U.S. Ser. No. 546,237, Filed Jun. 29, 1990, now abandoned. In the foregoing application, the disclosure shows that the discharge of the concentrated sludge from worm centrifuges can present considerable difficulties particularly when the solids to be discharged are soft and have a relatively low viscosity because the soft concentrated sludge can flow back into the treatment part of the worm centrifuge between the helix of the conveyor worm and the inside wall of the conical basket shell part. Proposals have been made to facilitate the discharge of the thick slurry such as by introducing a compressed air into the thick matter in the discharge region of the centrifuge to effectively loosen the thick matter. The quantity of solids discharged as well as the degree of concentration are set during centrifuge operation by varying the differential speed between the basket shell or bowl and conveyor worm of the centrifuge.

In the type of worm centrifuge referred to, an object of the invention is to provide an improved method and apparatus for guaranteeing a reliable independent setting parameter for regulating the desired degree of concentration of the solids discharged from the centrifuge without having to modify the differential speed between the basket shell and conveyor worm that has been optimally set for the best purification of the slurry.

A further object of the invention is to provide an improved method and apparatus for the more effective efficient and reliable operation of a worm centrifuge and thereby obtaining a better capability for a variety of slurries.

FEATURES OF THE INVENTION

In accordance with the invention, the reliable discharge of thick slurry from a worm centrifuge has been achieved by introducing a gaseous pressure agent into the concentrated sludge within the bowl, not in a continuous manner, but in an arrangement where pressure surges are introduced having a defined pulse frequency. Then, even when the solids to be discharged are soft and can be conveyed only with difficulty or not at all because of the flow past the worm helices of the conveyor, difficulties of conveyance and discharge are alleviated. The gaseous pressure medium is preferably compressed air. However, the invention contemplates introducing gas in the form of inert gas, heated gas, or steam. The gas to be used is impressed in surges and expands in the concentrated solid and reduces the average density thereof. As a result, the solid is pushed radially inward such as in sludge conveying and pushed in the direction of the solids discharge openings of the bowl and is hurled from the openings.

The quantity and degree of concentration of the solids to be discharged from the worm centrifuge can be set independently of the differential speed between the basket shell and conveyor worm. These speeds are normally optimally set for the best treatment of the slurry to be handled. Once having been achieved, the pulse frequency and the pressure intensity of the gas introduced can be established independently. As a result, costly variable speed gears and complicated differential speed controls are not necessary. In certain instances when exceeding specific limits, there is the possibility of additionally regulating the differential speed between the basket shell and conveyor worm in order to control the pressure medium surges.

As a feature of the invention, solids throughput is measured by the slurry admitted to the centrifuge. This can be measured by volume or by solids content in the indicia of dry matter content per time unit (TS). For example, this can be expressed in kg TS/h. The pulse frequency of the pressure medium surges is increased with increasing solids throughput and decreased with reduced solids throughput. The quantity of pressure medium to be introduced can be increased such as by shortening the pauses between successive pressure surges or by lengthening the duration of the individual pressure surges or by increasing the pressure of the pressure medium.

An unexpected result has occurred in that the solids content of the solids discharge can be kept approximately constant with controlled operation of the pulse frequency or the intensity of the pressure even though the solids content of the slurry admission to the centrifuge fluctuates.

A typical centrifuge utilized for operation of the invention is characterized in that a control is employed having a regulating valve with a pulse frequency generator connected to the gas input line. This control element is in interactive communication with a control means with a measuring instrument for measuring the solids throughput contained in the slurry admission.

Other objects, advantages and features will become more apparent with the teaching of the principles of the invention in connection with the disclosure of the preferred embodiments thereof in the specification, claims and drawing in which:

DESCRIPTION OF THE DRAWINGS

The single FIGURE of the drawing is a schematic showing of a solid bowl worm centrifuge constructed and operating in accordance with the principles of the present invention.

DESCRIPTION OF THE PREFERRED EMBODIMENTS

The drawing illustrates a solid bowl worm centrifuge having a basket shell 10 with a cylindrical body portion and a tapered portion at one axial end from which the solids are discharged. The basket shell is rotatably supported and connected to a rotatable drive means. A conveyor worm 12 is included within the shell having worm helices 13 secured to the worm member which conveys a concentrated solid 11 from the left to the right in the drawing. The worm rotates within the basket at a differential speed and is provided with separate control drive means.

The worm centrifuge has an axial slurry admission 14, with an outlet 15 for the discharge of the liquid fraction. A discharge 16 is provided from the sludge fraction which is concentrated within the centrifuge.

A thin slurry is admitted at 14 having a dry matter content, for example, of 0.5% to 1.5%. Such a material, for example, is obtained from the biological treatment stage of a sewage treatment plant and is laced with microorganisms. The operation requires that the slurry be concentrated in the centrifuge to form a sludge 16 having a dry matter content on the order of 5% through 10%. Concentrated sludge 16 is subsequently conveyed to a sludge digestion container. The liquid fraction has a minimum dry matter content on the order to 0.1% and it is withdrawn at the opposite end of the centrifuge.

Leading to the interior of the separator are means for delivering a compressed gas or air. This compressed air is introduced in successive pressure surges in the conical part of the basket shell between the flights of the conveyor worm. For this purpose, delivery discharge conduits 18 and 19 lead from the air pressure line 20 to discharge into concentrated sludge 11 at a region preceding the solids discharge openings 17. The delivery conduits 18 and 19 may be evenly distributed circumferentially around the axis of the shell. Also, the individual lines 18 and 19 are axially separated in a preferred form.

In a preferred embodiment as illustrated, the compressed air delivery conduit 18 discharges directly into the solids 11 that completely fill the annular space between the axis of the conveyor worm and the conical part of the basket shell 10. As indicated by the compressed air delivery conduit 19 there is the possibility of introducing further pressure medium into the solids 11 via nozzles arranged in the axis of the worm or in the worm helices. The compressed air is delivered with pressure surges so that as the pressure is released, the pressurized gas expands within the sludge in an explosive-like action. This will result in an explosive-like thrust of the solids to push them toward the solids discharge openings 17 and the solids fraction is hurled through these openings.

This makes it possible that the solids, when they are relatively soft, are expelled or discharged without having to modify the differential speed between the basket shell 10 and the conveyor worm 12 which have been set for a given type of slurry in an optimum control setting. Particles of heavy, medium or coarse substances which can be potentially contained in the solids, are also transported in the shell by the conveyor worm and are ejected at the solids discharge openings 17.

For regulating and controlling the solids discharged from the centrifuge, the solids throughput is measured such as by measuring the solids in the slurry admission 14. The pulse frequency, and the pressures of the surges of the supplied compressed air at 20 can be varied or controlled as a function of the solids content of the slurry delivered to the separator. The pressure surges of the compressed air will range preferably in the range of between 1 and 300 pulses per minute. An increase in this range is made with increasing solids throughput and, of course, a decrease in pulses is effected with decrease in solids throughput. Thus, the increase in pulse frequency of compressed air occurs proportionally, such as potentially linearly proportional relative to the measured solids throughput through the centrifuge.

For accomplishing the foregoing, compressed air surges are obtained by a control element 23 having a regulating valve providing a pulse frequency generator. This pulse frequency control is located in the air conduit 20 to control the supply of compressed air from a compressed air source 22 pressurized by an air compressor 21. The control element is operated by signal lines 24, 25, 26 and 27 via a control means 28. A suitable measuring instrument 31 is provided connected by lines 26 and 27 to measure volume flow and density at 29 and 30 of the slurry input via line 14 to the separator. Volume flow measurement at 29 ($m^3/h$) and density measurement at 30 ($kg/m^3$) are fed to the measuring device 31 which is a microprocessor having a multiplication unit.

The solids discharge from the centrifuge can be enhanced by elevating the pulse frequency of the compressed air surges introduced into the solids 11 via the regulating valve 23 and the conduit 20. By shortening the pauses between successive pressure surges, by lengthening the duration of the individual surges, or by increasing the gas pressure, the operation is thus suitably controlled. The compressed air is kept available in the storage container in a supply pressure on the order of 10 through 15 bar.

It has been discovered that the control of the compressed air surges supplied through the air conduit 20 cannot only control the quantity and degree of concentration of the solids discharge 16 but the solids content of the discharge and the liquid fraction can be kept approximately constant, even when the solids content in the slurry admission 14 fluctuates. As a result of the control, the operator can succeed in controlling the solids discharge 16 such that such solids remain pumpable and can be pumped to a sludge digestion container.

It is also contemplated that the air inlet lines 18 and 19 can be arranged to discharge at the radial outer edges of the flights. Thus, the solids can be radially transported from the outside to the center of the centrifuge according to a pump or airlift principle. It is also possible to provide an outlet through the shaft of the rotor for the conveyance of the solids toward an outlet 17.

Thus, it will be seen there has been provided an improved method and operation of a centrifugal separator which meets the objectives and advantages above set forth and provides for improved control in centrifugal separation operation.

I claim as my invention:

1. A method of operating a rotary bowl worm centrifuge for separating liquid/solids mixtures such as thickening a thin slurry comprising the steps:

introducing a slurry into a rotary bowl separator rotatable about an axis and having a worm therein to separate the slurry into a liquid fraction and a sludge fraction containing solids;

introducing a pressurized gas into concentrated sludge within the bowl in successive pressure surges;

and increasing a pulse frequency of said pressure surges of the pressurized gas as a function of increasing sludge fraction solids throughput through the centrifuge.

2. A method of operating a rotary bowl worm centrifuge for separating liquid/solids mixtures such as thickening a thin slurry in accordance with the steps of claim 1:

including maintaining a controlled output of the solids and the liquid fraction and varying the pressure of the gas introduced into said concentrated sludge.

3. A method of operating a rotary bowl worm centrifuge for separating liquid/solids mixtures such as thickening a thin slurry in accordance with the steps of claim 1:

including varying the pulse frequency of said pressure surges of the gas introduced into the concentrated sludge;

and varying the pressure of the gas introduced into the concentrated sludge.

4. A method of operating a rotary bowl worm centrifuge for separating liquid solids mixtures such as thickening a thin slurry in accordance with the steps of claim 1:

including introducing the pressurized gas at a plurality of locations within the bowl at spaced axial locations.

5. A method of operating a rotary bowl worm centrifuge for separating liquids/solids mixtures such as thickening a thin slurry in accordance with the steps of claim 1:

wherein the slurry introduced into the separator has a solids content in the range of 0.5% to 1.5% and the sludge fraction is discharged with a solids content in the range of 5% to 10%.

6. A method of operating a rotary bowl worm centrifuge for separating liquid/solids mixtures such as thickening a thin slurry in accordance with the steps of claim 1:

wherein the successive pressure surges are controlled and introduced in the range of between 1 and 300 pulses per minute.

7. A method of operating a rotary bowl worm centrifuge for separating liquid/solids mixtures such as thickening a thin slurry in accordance with the steps of claim 1:

wherein the pressurized gas is introduce at a pressure in the range of 10 to 15 bar.

8. A method of operating a rotary bowl worm centrifuge for separating liquid/solids mixtures such as thickening a thin slurry in accordance with the steps of claim 1:

wherein the pressurized gas is heated prior to introduction into the centrifuge.

9. A method of operating a rotary bowl worm centrifuge for separating liquid/solids mixtures such as thickening a thin slurry in accordance with the steps of claim 1:

wherein the pressurized gas is in the form of steam.

10. A method of operating a rotary bowl worm centrifuge for separating liquid/solids mixtures such as thickening a thin slurry in accordance with the steps of claim 1:

including varying pauses between successive pressure surges.

11. A method of operating a rotary bowl worm centrifuge for separating liquids/solids mixtures such as thickening a thin slurry in accordance with the steps of claim 1:

including varying the time duration of individual pressure surges.

12. A method of operating a rotary bowl worm centrifuge for separating liquid/solids mixtures such as thickening a thin slurry in accordance with the steps of claim 1:

including measuring a solids content of slurry delivered to the centrifuge; and increasing the pulse frequency of the pressurized gas as a function of an increase of the solids content measurement of the delivered slurry.

13. A method of operating a rotary bowl worm centrifuge for separating liquid/solids mixtures such as thickening a thin slurry comprising the steps:

introducing a slurry into a rotary bowl separator rotatable about an axis and having a worm therein to separate the slurry into a liquid fraction and a sludge fraction containing solids and having an outlet for said liquid fraction and an outlet for said sludge fraction;

introducing a pressurized gas into concentrated sludge within the bowl through a gas pressure line leading into the bowl in successive pressure surges;

and increasing a pulse frequency of said pressure surges of the pressurized gas as a function of increasing sludge fraction solids throughput through the centrifuge.

* * * * *